US007341377B1

(12) United States Patent
Baxter

(10) Patent No.: US 7,341,377 B1
(45) Date of Patent: Mar. 11, 2008

(54) CYLINDRICAL CONTAINER BAGS

(76) Inventor: John D. Baxter, 265 Largo Cir., #303, West Melbourne, FL (US) 32901

( * ) Notice: Subject to any disclaimer, the term of this patent is extended or adjusted under 35 U.S.C. 154(b) by 577 days.

(21) Appl. No.: 10/723,078

(22) Filed: Nov. 26, 2003

(51) Int. Cl.
*B65D 30/22* (2006.01)
*B65D 30/04* (2006.01)
*B65D 33/02* (2006.01)
*A45F 5/00* (2006.01)

(52) U.S. Cl. ..... 383/38; 383/117; 383/119; 294/159

(58) Field of Classification Search ..... 383/117, 383/38, 119, 903; 294/152, 159, 162; 190/109–111
See application file for complete search history.

(56) References Cited

U.S. PATENT DOCUMENTS

| | | | | | |
|---|---|---|---|---|---|
| 253,614 | A | * | 2/1882 | Lowenherz | 190/125 |
| 3,951,259 | A | | 4/1976 | Oglesbee | 206/164 |
| 3,964,266 | A | | 6/1976 | Bartlett | 61/70 |
| 4,022,343 | A | * | 5/1977 | Richardson | 206/521 |
| 4,168,007 | A | | 9/1979 | Rohatensky | 211/71 |
| 4,290,529 | A | | 9/1981 | Jones et al. | 211/13 |
| 4,438,764 | A | * | 3/1984 | Eppolito | 128/205.22 |
| 4,621,737 | A | | 11/1986 | Casey | 211/70.5 |
| 4,722,333 | A | * | 2/1988 | Bartos | 128/202.27 |
| 4,773,348 | A | | 9/1988 | Rowley | 114/219 |
| 4,889,306 | A | | 12/1989 | Boucher | 248/313 |
| 4,899,968 | A | | 2/1990 | Eaglin et al. | 248/131 |
| 5,025,935 | A | | 6/1991 | Hadachek | 211/71 |
| 5,082,464 | A | | 1/1992 | Clink | 440/6 |
| 5,127,531 | A | | 7/1992 | Onodera | 211/74 |
| 5,147,079 | A | * | 9/1992 | Heather | 224/148.6 |
| 5,148,932 | A | | 9/1992 | Orefice | 220/23.2 |
| 5,267,815 | A | | 12/1993 | Feder | 405/186 |
| 5,299,721 | A | | 4/1994 | Cummings | 224/42.42 |
| 5,381,916 | A | | 1/1995 | Strawder | 220/23.4 |
| 5,447,216 | A | * | 9/1995 | Freyvogel | 190/18 A |

(Continued)

OTHER PUBLICATIONS

Oxygen Tanks—Cylinders—Regulators by TriMed, wysiwyg://0.48/http://www.trimed.freeservers.com/TM/page12.htr, pp. 1-3, Sep. 9, 2002.

(Continued)

*Primary Examiner*—Jes F. Pascua
(74) *Attorney, Agent, or Firm*—Brian S. Steinberger; Law Offices of Brian S. Steinberger, P.A.

(57) ABSTRACT

Tank tote bags for storing cylinders such as diving tanks, welding tanks, and medical tanks such as oxygen tanks, in separate compartments that can be arranged in either vertical upright positions or horizontal laid down positions. One bag version has two tanks that can be arranged side-by-side in a bag with a mesh material behind the tanks, an open front and open top, and horizontal and vertical straps for holding the tanks together and separate from one another. Another bag version has three tanks arranged in a triangular arrangement. And another version has five tanks arranged in a triangular configuration. A still another version has four tanks arranged in a stacked two by two arrangement in a bag with a closeable top. The bags can be used in pickup truck beds and boats, homes and garages. The bags can be lightweight and can be easily carried and handled by one hand and later folded into small compact spaces.

12 Claims, 11 Drawing Sheets

U.S. PATENT DOCUMENTS

| | | | | |
|---|---|---|---|---|
| 5,544,499 | A | 8/1996 | Boggs | 66/1 A |
| 5,546,885 | A | 8/1996 | Porada | 114/345 |
| 5,609,282 | A | 3/1997 | Melanson | 224/576 |
| 5,788,475 | A | 8/1998 | Henderson | 405/186 |
| 5,833,197 | A | 11/1998 | Peabody | 248/346.01 |
| 5,901,890 | A | 5/1999 | Stokes | 224/406 |
| 6,056,255 | A | 5/2000 | Meade | 248/313 |
| 6,109,581 | A | 8/2000 | Kracke et al. | 248/311.3 |
| 6,155,206 | A * | 12/2000 | Godshaw | 119/453 |
| 6,158,587 | A | 12/2000 | Emery | 206/427 |
| 6,805,225 | B2 * | 10/2004 | Freedman | 190/112 |
| 7,017,741 | B1 * | 3/2006 | Williamson | 206/386 |

OTHER PUBLICATIONS

Portable Cylinder Systems, Pulse Dose by CHAD, wysiwyg://0.48/http://www.trimed.freeservers.com/TM/page16.htr, pp. 1-2, Sep. 9, 2002.

* cited by examiner 100
3
9
6
112
8
2
4
40
10
20
50

115
117
134
132
150

13 / 113
15 / 115
12 / 112

28 / 128
22 / 122

120
112
132
115
160
60
32
8
9
134
117
4
2
35
20
20

112
120
115
132
135
34
76
174
117
134
172
36
35
78
20
72
74

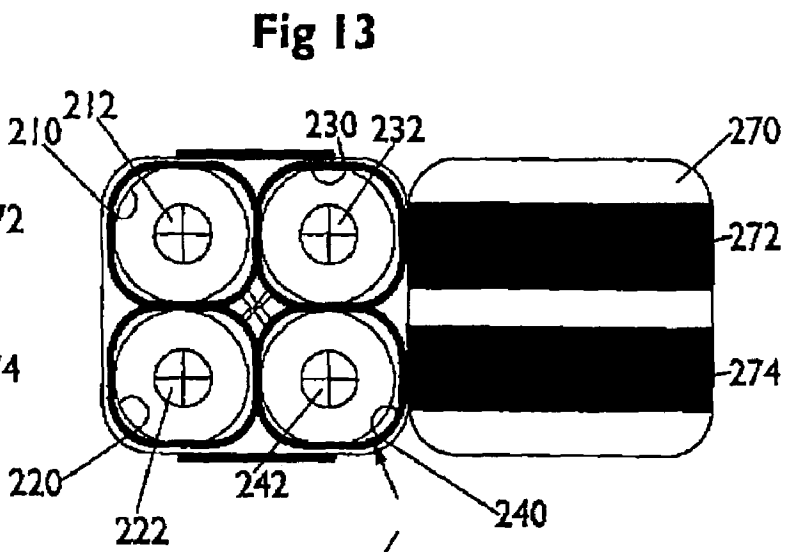
Fig 13
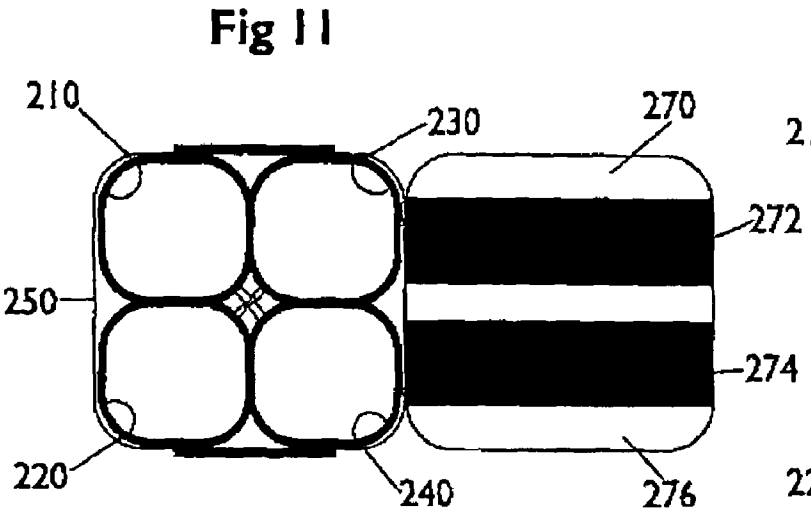
Fig 11
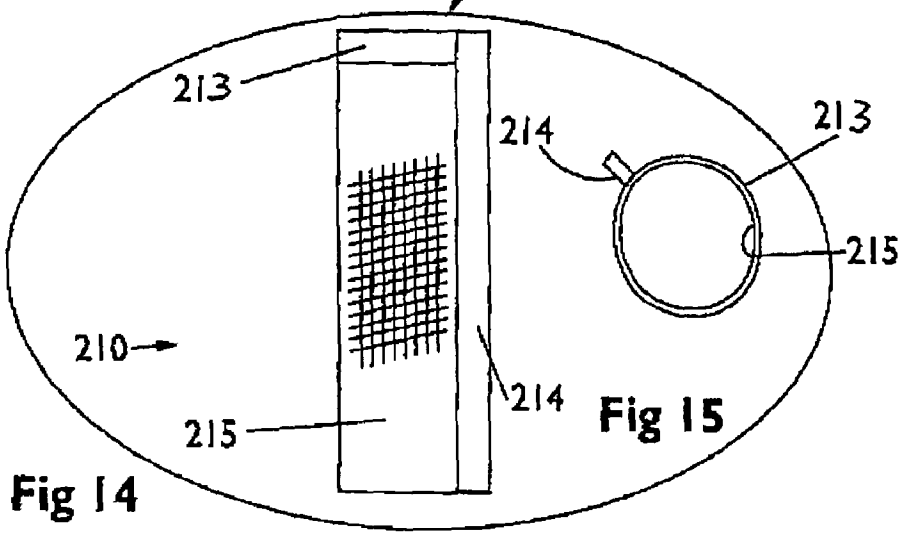
Fig 15
Fig 14
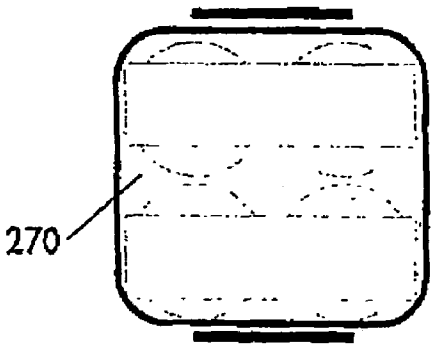
Fig 12 A

CYLINDRICAL CONTAINER BAGS

This invention relates to tanks, and in particular to lightweight, durable, pliable, and carriable bags for separating and holding combinations of two, three, four and five tanks, such as diving tanks, oxygen tanks and cylinders together in side by side arrangements, and for protecting the exterior of the tanks from being damaged as well as surface areas of storage locations such as homes, vehicles, boats, and the like, from being damaged, and for allowing plural tanks to be handled and/or carried by a single user.

BACKGROUND AND PRIOR ART

Tanks such as scuba diving tanks, oxygen tanks and cylinders contain pressurized gas that can become hazardous if not properly stored or handled. Additionally, it is preferable that the tanks be consistently transported and stored in a vertical position as opposed to a horizontal position. The horizontal position can cause damage, marring and scratches, thus increasing the likelihood of corrosion. Additionally, storing tanks in horizontal positions on their sides takes up an unnecessary waste of floor space. Merely storing the diving tanks in an upright position is not safe since the unsecured tanks can tip, fall over and hit against one another. Using rope and bungee cords is generally not a practical solution for storing loose tanks in pickup truck beds, garages, boats, dive shops and the like.

Backpacks and single tank storage bags have been used by divers to store their cylinder tanks when the tanks are not being used. There are several problems with using the backpacks and single tank storage bags. First, most backpacks do not often allow for the tanks to be stored in upright position on a floor surface. Secondly, backpacks usually only have room for storing up to at most two tanks. Many professional and sportsman divers normally take three or more tanks on a dive trip. The problem becomes compounded when plural divers go to a dive trip. In fact normal safety procedures require two divers teamed up with one another for a single dive. Thus, the divers often need more than two tanks at any given time, and need to safely store and handle these tanks. With current backpacks and single tank storage bags, the user is often forced to handle and carry plural backpacks, and plural single tank storage bags. Thus, backpacks and single tank storage bags do not take care of most divers' needs.

The inventor is aware of several types of devices that can be used for storing dive tanks. See for example, U.S. Pat. Nos. 3,964,266 to Bartlett; 4,495,883 to Hoy; 4,889,306 to Boucher; 5,025,935 to Hadachek; 5,082,464 to Clink; 5,267,815 to Feder; 5,299,721 to Cummings; 5,788,475 to Henderson; 5,833,197 to Peabody; and 5,901,890 to Stokes. However, none of these devices singularly or in combination overcomes all of the problems described above. A device sold under the name "Pelican Tank Racks" shows racks for holding four and six air tanks. However, the Pelican Tank Racks require using "carbon steel" that is wrapped in polyester coating layer into large wire cages having large mesh opening. These racks are expensive to hold and carry excessive weight when being used.

In addition, the inventor is aware of other types of devices that can be used for storing oxygen tanks. There are wheel carts for oxygen tanks cylinders that carry one (1) tank. These are used by the user to provide some portability while employing the use of the air. Further, there are pouches that also allow portability, and are generally carried or attached to the wheel chairs.

The inventor is also aware steel type racks for storage of oxygen tanks. These types of racks are bulky and heavy not allowing for portability.

Thus, the need exists for solutions to the problems with the prior art.

SUMMARY OF THE INVENTION

A primary objective of the present invention is to provide a lightweight and durable tank storage bag for storing and toting two, three, four, or five, cylinder tanks in one carrying bag.

A secondary object of this invention is to provide a lightweight and durable tank storage bag for holding tanks in vertical upright positions side by side in a close configuration without abutting one another.

A third object of this invention is to provide a lightweight and durable tank storage bag for holding tanks in horizontal laid down positions side by side in a close configuration without abutting one another.

A fourth object of this invention is to provide a lightweight and durable tank storage bag for storing with a boat.

A fifth object of this invention is to provide a lightweight and durable tank storage bag that can be used in a vehicle such as the bed of a truck, jeep, SUV, station wagon, and the like.

A sixth object of this invention is to provide a lightweight and durable tank storage bag that can be used in a trunk of a vehicle.

A seventh object of this invention is to provide a lightweight and durable tank storage bag that can be used in home or garage.

An eighth object of this invention is to provide a lightweight and durable tank storage bag that allows individual tanks to be easily accessible for cleaning and maintenance.

A preferred embodiment of a tank container bag can include a first compartment having a first flexible and pliable strap frame, adapted for holding a first cylindrical tank therein, and a second compartment having a second flexible and pliable strap frame, adapted for holding a second cylindrical tank therein, the first compartment being attached in a side-by-side to the second compartment in a combined arrangement, wherein the combined arrangement allows for the first cylindrical tank and the second cylindrical tank to be stored in an upright vertical position, a horizontal position, and allows for the bag to be handled and carried by a single user.

Pliable and flexible mesh material can be used for covering a rear side of the bag, so that top ends, and front sides of the first and the second cylindrical tanks are left exposed.

The bag can have four vertical straps parallel to one another forming a back of the bag with the mesh material attached across the four vertical straps.

Additionally, the bag can have an inwardly folded vertical edge of mesh material midway down the mesh material for separating the first tank from the second tank.

Underneath the bag can be sets of flexible crossed straps under the compartments for supporting the tanks, therein.

The bags can include an upper horizontal strap positioned to pass about upper side portions of the first and the second cylinder, and a lower horizontal strap positioned to pass about lower side portions of the first and the second cylinders. The straps can include adjustable fastening features for allowing the straps to be tightly wrapped about the first and the second cylinders.

A third compartment having a third flexible and pliable strap frame, adapted for holding a third cylindrical tank therein, can be attached along a midportion behind the first and the second compartment, the first and the second and the third compartments being arranged in a triangular configuration. Pliable and flexible mesh material can be used for covering rear sides of each compartment of the bag, so that a top ends and front sides of the tanks are exposed.

Another triangular configuration can have two rows of compartments(two in the front, three there-behind) for holding five cylindrical tanks.

Another version can include a top lid formed from a pliable and flexible material that can be positioned from a flap open position to a closed position, by zipper fasteners, and the like. Compartments can each contain tubular containers each formed from tubular pliable and flexible mesh material adapted for substantially enclosing the first and the second cylinders therein. A bottom cover can close off the bag and be formed from a pliable and flexible material.

The top lid and the bottom lid can each have a webbing material formed from a pliable and flexible material running down a middle portion of a pliable and flexible mesh material. Side straps and webbing can also be used for adding rigidity and strength to the bag, and have upper looped portions that can function as handles for raising and lowering the bag.

Further objects and advantages of this invention will be apparent from the following detailed description of the presently preferred embodiments which are illustrated schematically in the accompanying drawings.

BRIEF DESCRIPTION OF THE FIGURES

FIG. 11 is a top view of the tank tote of FIGS. 10A-10B with open top.

FIG. 12A is a top view of the tank tote of FIG. 9 with closed top.

FIG. 13 is a top view of the tank tote of FIG. 11 with tanks inside.

FIG. 14 is a side view of a single compartment used in the tank tote of FIGS. 9-12.

FIG. 15 is a top view of the single compartment of FIG. 14.

DESCRIPTION OF THE PREFERRED EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

Double Cylinder Bag Embodiment

Figure 2B:
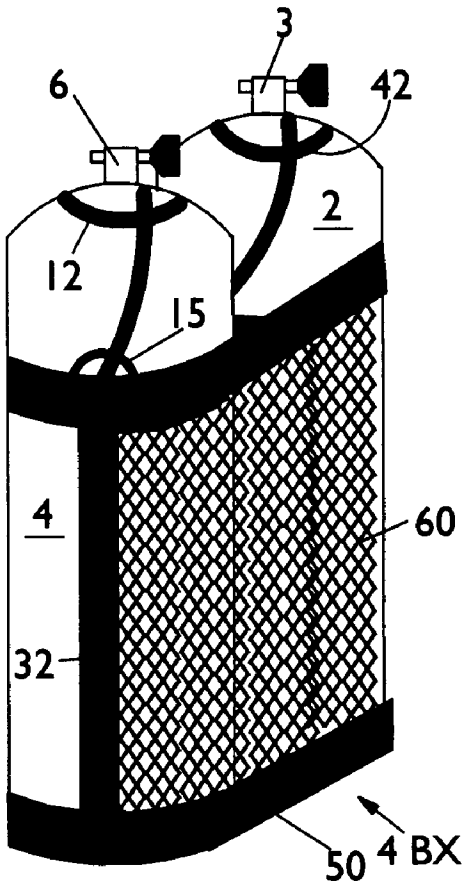
FIG. 2B is a rear left perspective view of the double bag tank tote with cylinders.
Figure 2A:
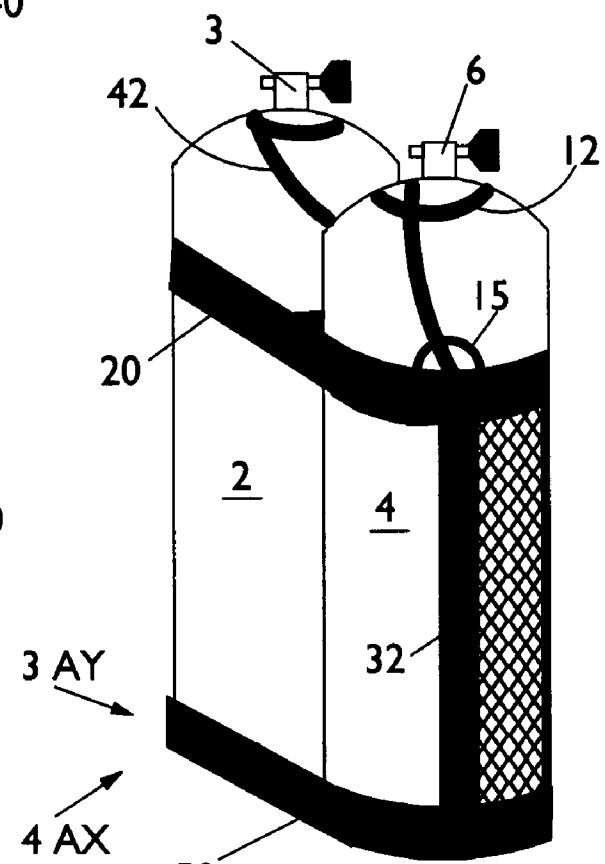
FIG. 2A is a front right perspective view of the double bag tank tote with cylinders.
Figure 1:
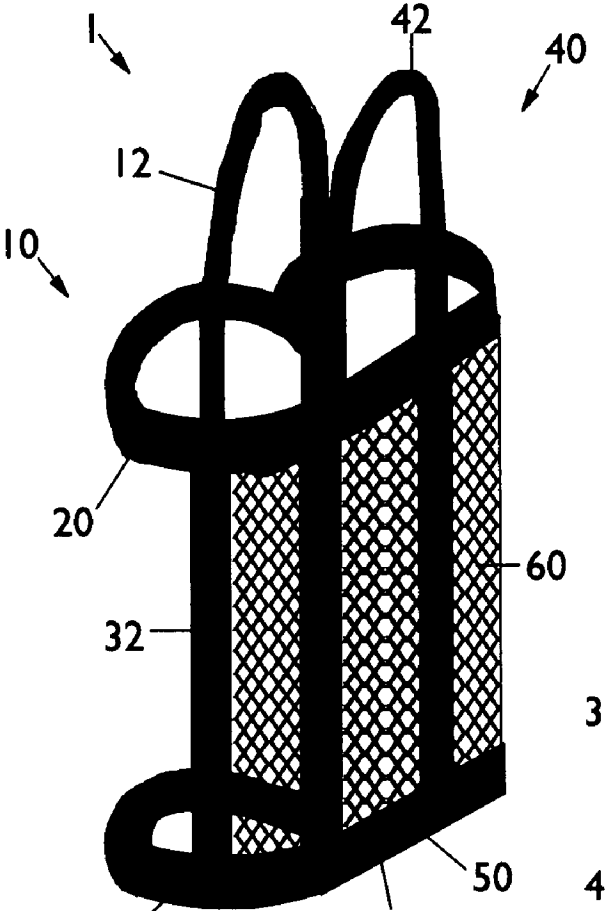
FIG. 1 is a rear perspective view of an empty double bag tank tote embodiment.
Figure 3B:
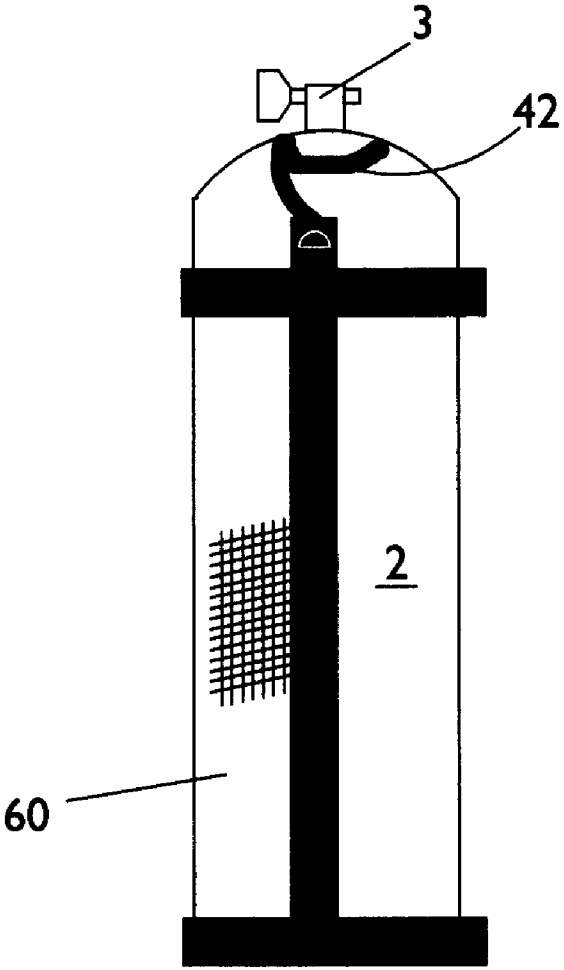
FIG. 3B is a left side view of the double bag tank tote of FIG. 2A along arrow 3AY.
Figure 3A:
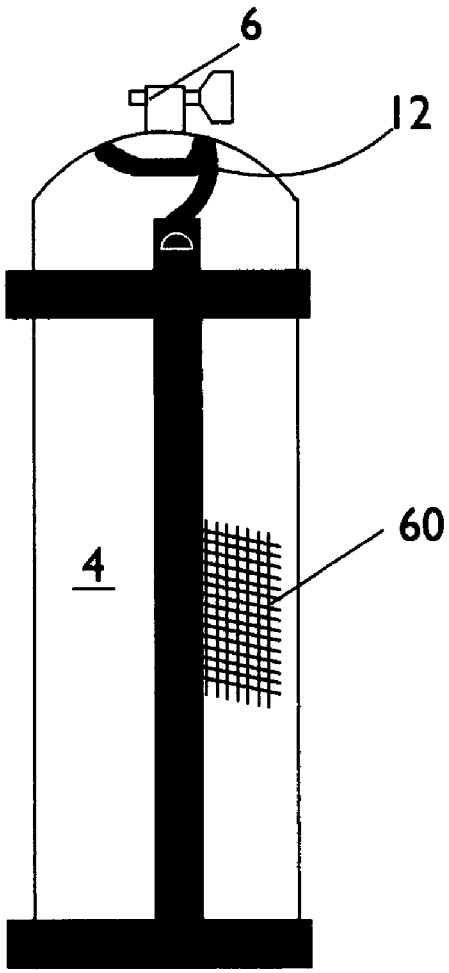
FIG. 3A is a right side view of the double bag tank tote of FIG. 2A along arrow 3AX.
Figures 4A, 4B, 4C, 4D:
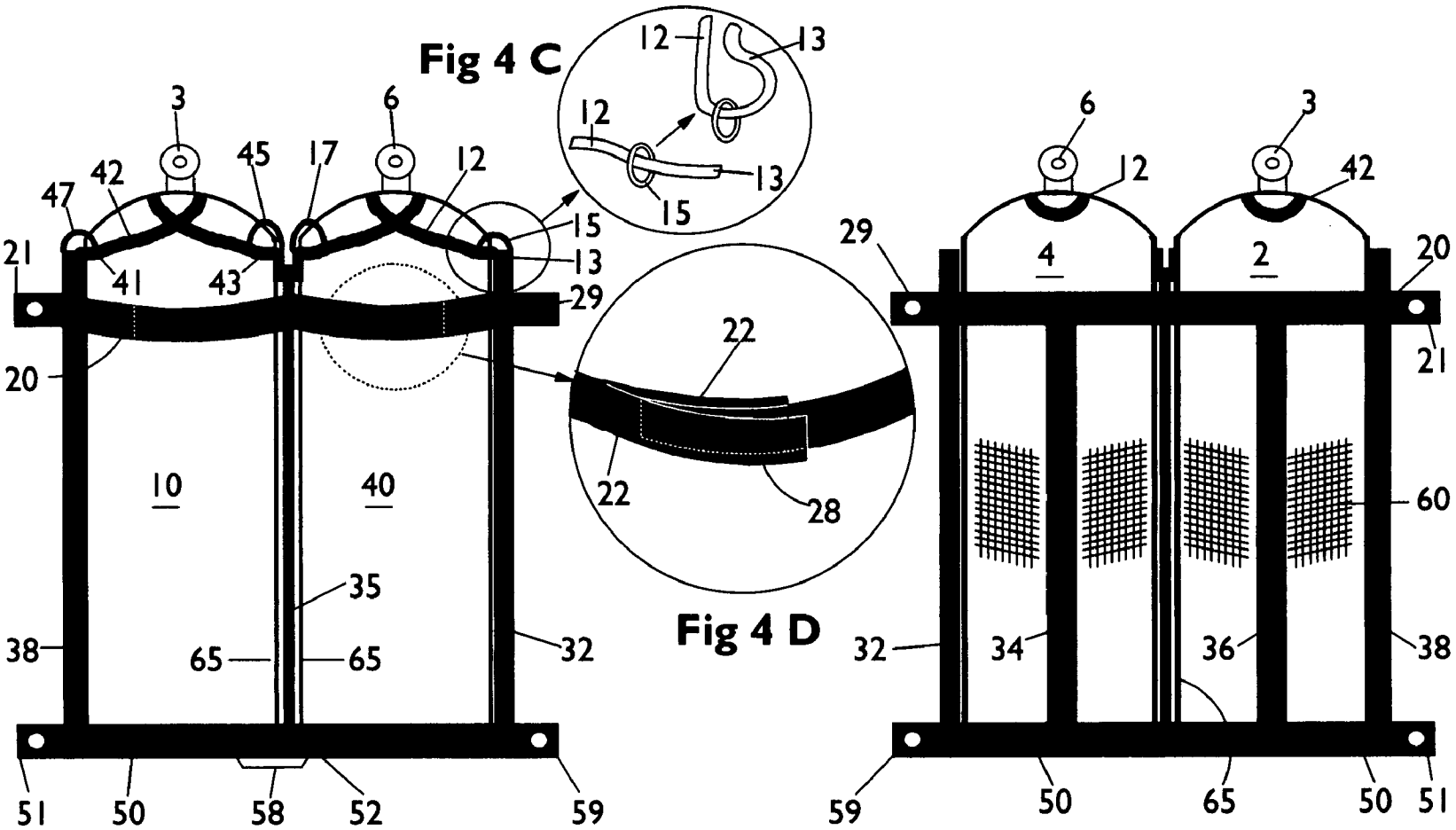
FIG. 4A is a front side view of the double bag tank tote of FIG. 2A along arrow 4AX.
FIG. 4B is a rear side view of the double bag tank tote of FIG. 2B along arrow 4BX.
FIG. 4C is an enlarged view of the valve strap and upper right bag connection loop of FIG. 4A.
FIG. 4D is an enlarged view of the front straps of the FIG. 4A used to hold cylinders in place.
Figure 4F:
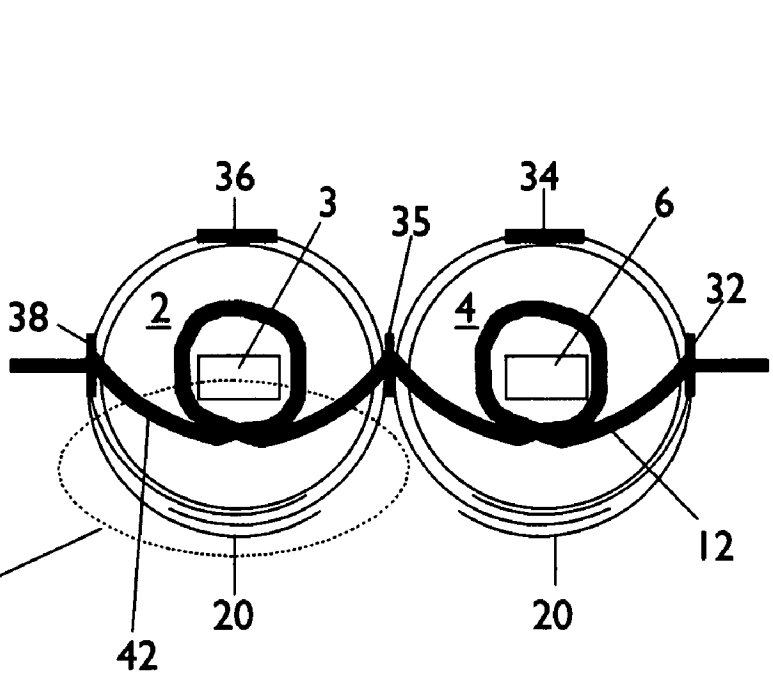
FIG. 4F is a top view of the double bag tank tote of the preceding figures.
Figure 4E:
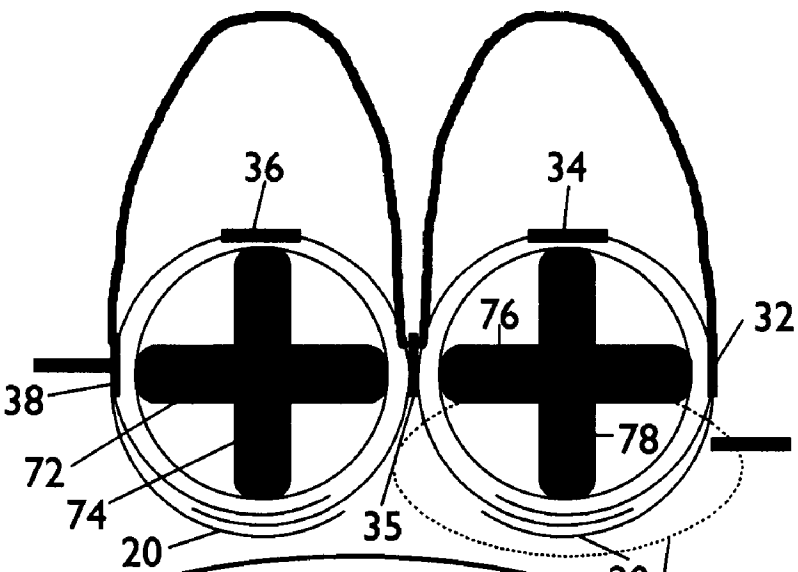
FIG. 4E is a top view of the double bag tank tote of the preceding figures without cylinders.
Figure 4G:
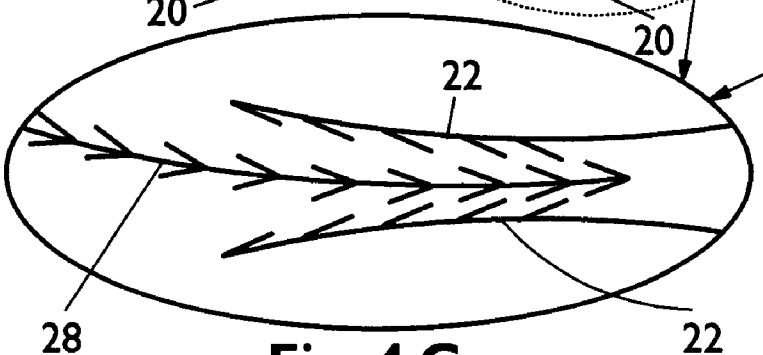
FIG. 4G is an enlarged view of the hook and loop fastened front straps of FIGS. 4A, 4C, and 4E.

FIG. 1 is a rear left perspective view of an empty double bag tank tote. 1. FIG. 2A is a front right perspective view of the double bag tank tote 1 of FIG. 1 with cylinders 2, 4, such as scuba tank air cylinders, and the like, with upper air flow valves 3, 6, respectively. FIG. 2B is a rear left perspective view of the double bag tank tote 1 of the preceding figures with cylinders 2, 4. FIG. 3A is a right side view of the double bag tank tote 1 of FIG. 2A along arrow 3AX. FIG. 3B is a left side view of the double bag tank tote 1 of FIG. 2A along arrow 3AY. FIG. 4A is a front side view of the double bag tank tote 1 of FIG. 2A along arrow 4AX. FIG. 4B is a rear side view of the double bag tank tote 1 of FIG. 2B along arrow 4BX. FIG. 4C is an enlarged view of the valve strap and upper right bag connection loop of FIG. 4A. FIG. 4D is an enlarged view of the front straps of the FIG. 4A used to hold cylinders in place. FIG. 4E is a top view of the double bag tank tote 1 of the preceding figures without cylinders therein. FIG. 4F is a top view of the double bag tank tote 1 of the preceding figures. FIG. 4G is an enlarged view of the hook and loop fastened front straps used in the front of the compartments 10, 40 of the tote bag 1 of FIGS. 4A, 4C, 4E.

Referring to FIGS. 1-4G, tote bag 1 can include double compartments 10, 20 for supporting cylindrical type air tanks 2, 4 therein. The bag 1 can allow for the cylindrical tanks to be able to remain in a standing position, and also allow to be laid in a horizontal orientation position as well.

The top of each compartments 10, 40 can include upper longitudinal rectangular planar straps 12, 42 with ends 11, 13 and 41, 43 that can wrap and be fastened about loops 15, 17, 45, 47 that are pre-attached to an upper horizontal rectangular planar strap 20 running across the bag 1. Mid-portions of the upper longitudinal straps 12, 42 can be wrapped about stem portions of air valves 3, 6 that are located on the cylinders 2, 4, so that the straps 12, 42 hold the cylinders 2, 4 to the bag 1.

The straps 12, 42, 20, 30, 50 can be formed from a flexible and pliable material such as nylon cloth webbing material, and the loops 15, 17, 45, 47 can be stainless steel, galvanized steel, plastic preformed loops that can be sewn to upper horizontal strap 20.

Along a rear side of the bag 1 behind cylinders 2, 4 can be a mesh material 60 that can be formed from a flexible and pliable nylon mesh type material, with open pores, and the like. Mesh backing material 60 can be attached to upper horizontal strap 20 and to lower horizontal rectangular planar strap 50. Attached to both the upper horizontal strap, 20 and the lower horizontal strap 50 can be parallel vertical planar rectangular straps 32, 34, 36, 38. Straps can be attached to one another by sewing, webbing, and the like. Between the middle vertical straps 34, 36 can be a portion 65 of the mesh backing material 60 folded inwardly in order to form a separator for the cylinders 2, 4. In between the folded longitudinal mesh portion 65 can be another vertical strap 35. The straps 32, 34, 35, 36, 38 can be attached to the mesh material 60 by sewing, and the like.

The front of bag 1 can have ends 22, 28 of the upper horizontal strap 20, and ends 52, 58 of the lower horizontal strap attached to each other by fasteners such as hook and loop fasteners and the like. As shown in FIG. 4G, the strap ends 22 can also include double strap ends for allowing a more secure fastening effect with strap end 28.

As shown in FIGS. 4A, 4D, 4E, the front of upper horizontal strap 20 can include two sets of ends 22, 28 in front of each compartment 10, 40. Here, the straps 20 can be attached to side vertical straps 38 and 32 as well as to the middle vertical strap 35 that separates the space between the two stored cylinders 2, 4.

Additionally, the strap 20 can have a single set of ends that fastens in front of the cylinders 2, 4. The width of the loop space formed by strap 20 can be adjusted as desired and further tightened to securely hold cylinders 2, 4 to the bag 1.

The lower strap 50 can be formed into a single fixed loop about the cylinders 2, 4. Additionally, the lower strap 50 can have fastening ends similar to that of upper strap 20 in front of both compartments 10, 40, or a single fastening ends point in front of the cylinders 2, 4.

Underneath the compartments 10, 40 of the bag 1, can be a first set of crossed flexible and planar nylon mesh type straps 72, 74 and second set of crossed flexible and planar nylon, (Note: material options can include nylon, polypropylene, polyester, combinations thereof, and the like) type straps 76, 78 that are attached by sewing, and the like, to the lower horizontal strap 50. The first and second sets of crossed straps 72, 74 and 76, 78 hold and support the bottom of the cylinders 2, 4 within the bag 1.

Additional strap ends 21, 29, 51, 59 each with eyelet through-holes formed therein(can have metal and plastic loops sewn therein) and can each extend out from each end of upper horizontal strap 20, and lower horizontal strap 50. These strap ends 21, 29, 51, 59 with eyelets can be used to further tie and fasten the bag 1 with or without cylinders 2, 4 inside of boats, vehicles, trunks, and the like. Additionally, these strap ends 21, 29, 51, 59 with eyelets can be used to further tie and fasten the bag 1 to other bags 1, and can be used to attach further straps thereto so that the bags are more easily portable. The bag 1 can also be carried and handled in an empty or full state by grabbing onto any one of the straps on the bag.

Triple Cylinders Triangular Bag Embodiment

Figure 6B:
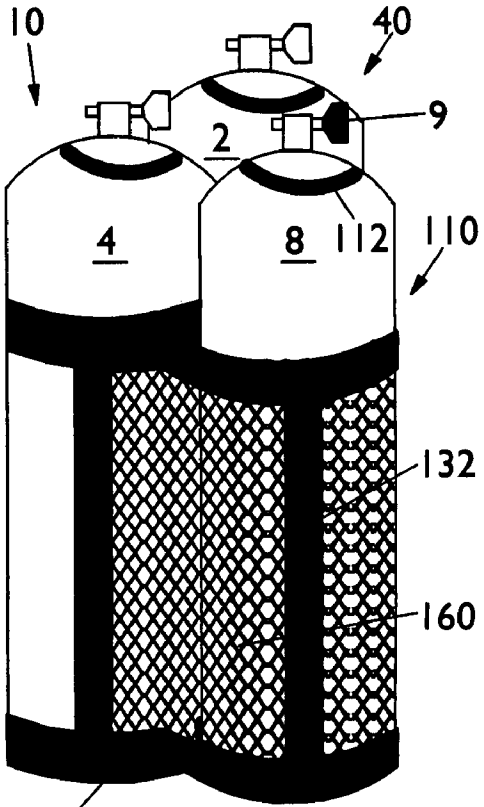
FIG. 6B is a rear left perspective view of the triple bag tank tote with cylinders.
Figure 6A:
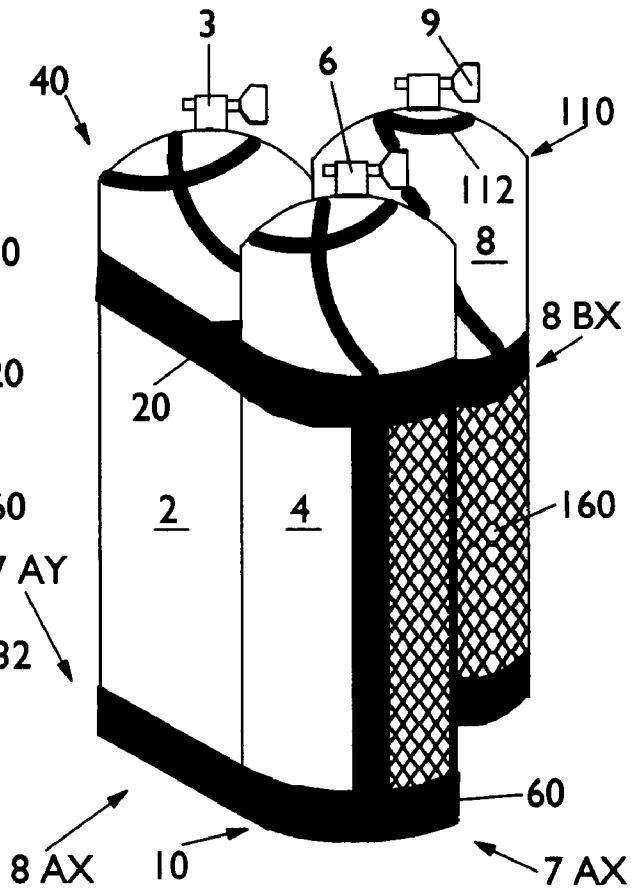
FIG. 6A is a front right perspective view of the triple bag tank tote with cylinders.
Figure 5:
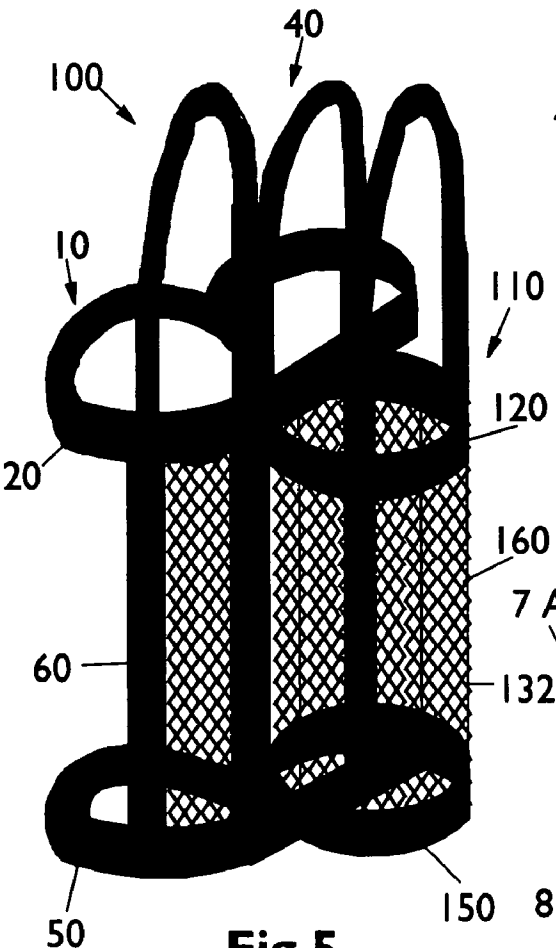
FIG. 5 is a rear perspective view of an empty triple bag tank tote embodiment.
Figure 7B:
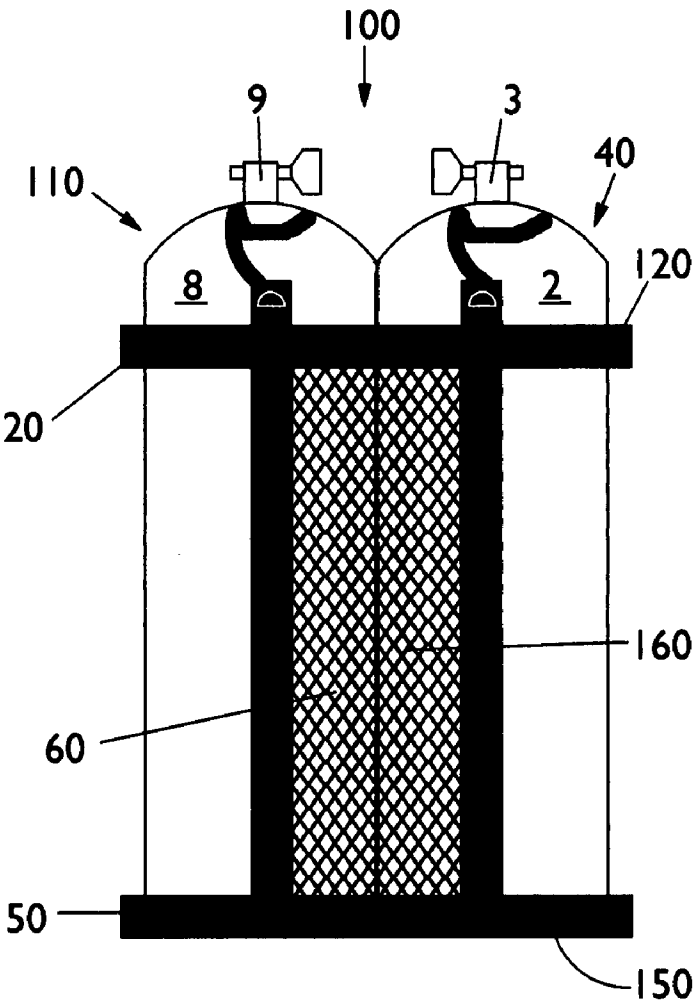
FIG. 7B is a left side view of the triple bag tank tote of FIG. 6A along arrow 7AY.
Figure 7A:
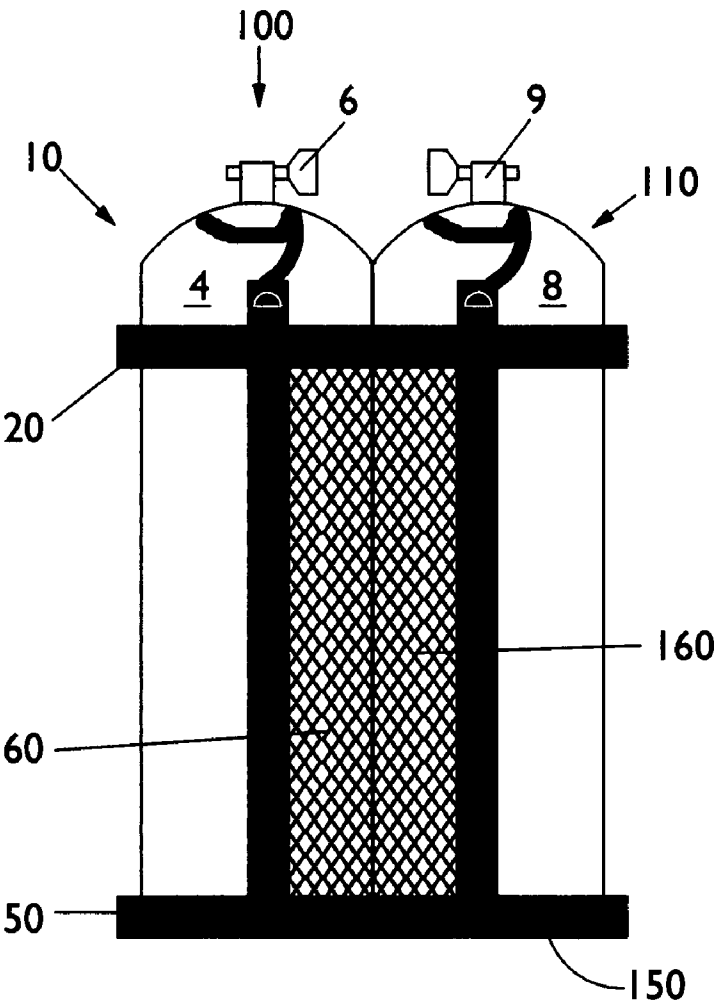
FIG. 7A is a right side view of the triple bag tank tote of FIG. 6A along arrow 7AX.
Figures 8A, 8B, 8C, 8D:
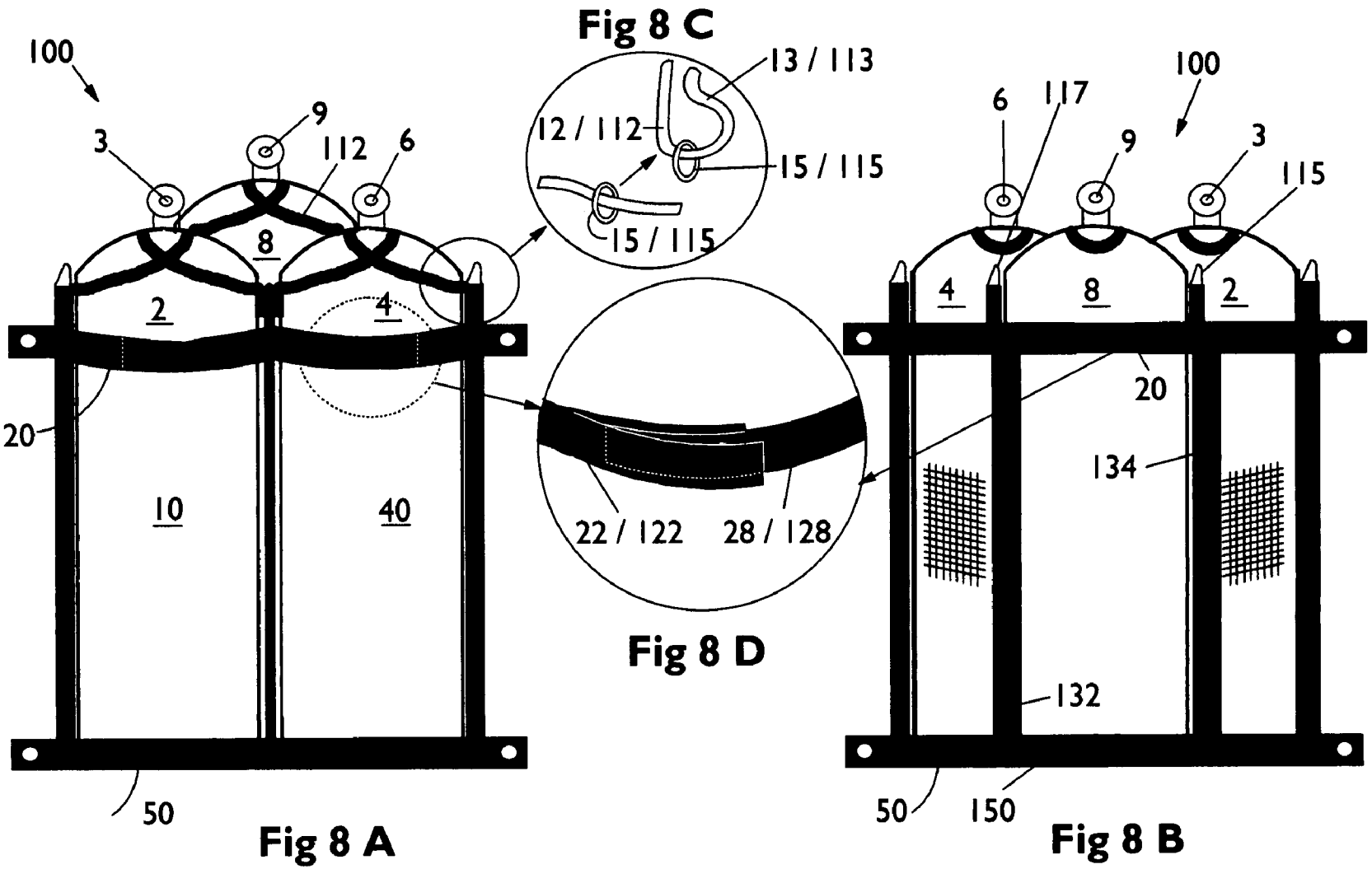
FIG. 8A is a front side view of the triple bag tank tote of FIG. 6A along arrow 8AX.
FIG. 8B is a rear side view of the triple bag tank tote of FIG. 6B along arrow 8BX.
FIG. 8C is an enlarged view of the valve strap and upper right bag connection loop of FIG. 6A.
FIG. 8D is an enlarged view of the front straps of the FIG. 6A used to hold cylinders in place.
Figures 8E, 8F, 8G:
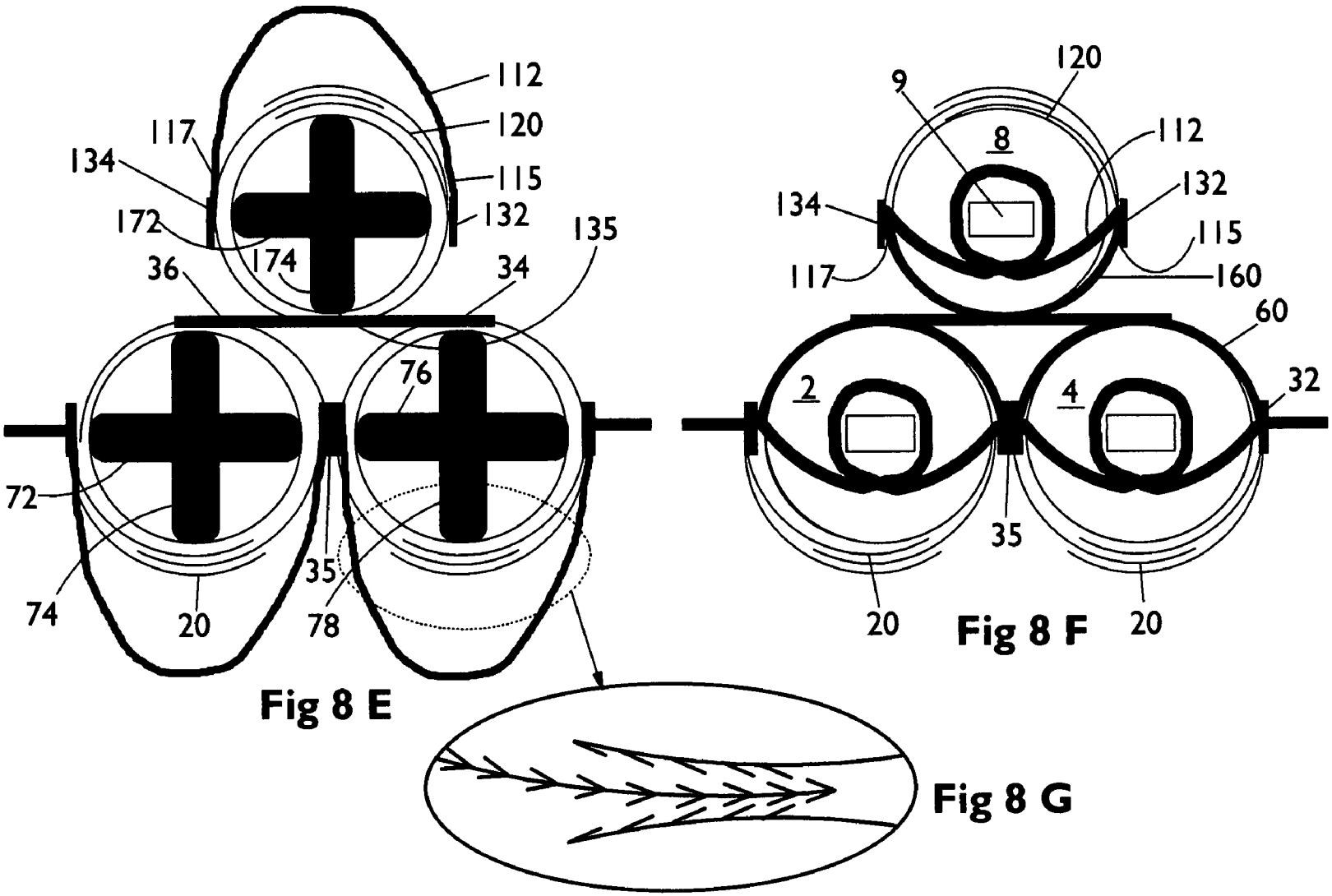
FIG. 8E is a top view of the triple bag tank tote of the preceding figures without cylinders.
FIG. 8F is a top view of the triple bag tank tote of the preceding figures.
FIG. 8G is an enlarged view of the hook and loop fastened front straps of FIGS. 6A, 6C, and 6E.

FIG. 5 is a rear perspective view of an empty triple bag tank tote embodiment 100 with compartments 10, 40, 110 adapted for holding cylinders, such as compressed air cylinder tanks therein. FIG. 6A is a front right perspective view of the triple bag tank tote with cylinders 3, 6, 8 in each of the compartments 10, 40, 110. FIG. 6B is a rear left perspective view of the triple bag tank tote 100 with compartments 10, 40 and 110 and cylinders 2, 4, 8. FIG. 7A is a right side view of the triple bag tank tote 100 of FIG. 6A along arrow 7AX. FIG. 7B is a left side view of the triple bag tank tote 100 of FIG. 6A along arrow 7AY. FIG. 8A is a front side view of the triple bag tank tote 100 of FIG. 6A along arrow 8AX. FIG. 8B is a rear side view of the triple bag tank tote 100 of FIG. 6B along arrow 8BX. FIG. 8C is an enlarged view of the valve strap and upper right bag connection loop of FIG. 6A. FIG. 8D is an enlarged view of the front straps of the containers 10, 40 and 110 of the preceding figures used to hold cylinders 2, 4, 8 in place. FIG. 8E is a top view of the triple bag tank tote 100 of the preceding figures without any cylinders stored inside. FIG. 8F is a top view of the triple bag tank tote 100 of the preceding figures. FIG. 8G is an enlarged view of the hook and loop fastened front straps of FIGS. 6A, 6C, 6E.

Referring to FIGS. 5-8G, the triple bag tote 100 can include the compartments 10, 40 and associated straps and associated components that are used in the double bag tote 1 previously described above, with the addition of a third compartment 110 attached by sewing, and the like, to a rear side of the double compartment tote 1.

Third compartment 110 can have an upper horizontal strap 120 similar to horizontal strap 20, and have ends 122, 128 that fasten together similar to strap ends 22, 28 previously described, where the strap ends 122, 128 can be adjusted to tightly hold an upper portion of the third cylinder 8 to the bag 100.

Across a lower portion of third cylinder 8 can be a lower horizontal strap 150 that can be similar to lower horizontal strap 50 previously described, and be used for holding a lower portion of cylinder 8 to bag 100. Strap 150 can be in a fixed one-size state. Alternatively, strap 150 can be adjusted and tightened by having loose ends similar to strap 20 that can be fastened together by hook, and loop fasteners, and the like.

Underneath compartment 110, can be a set of a third set of crossed flexible and planar nylon type straps 172, 174, similar to crossed straps 72, 74, 76, 78 previously described, that are attached by sewing, and the like, to the lower horizontal strap 150. Similar to the first and second sets of crossed straps 72, 74 and 76, 78, the third set of crossed straps 172, 174 holds and supports the bottom of the cylinder 8 within bag 100.

The top of compartment 110 can include an upper longitudinal rectangular planar strap 112 with ends 111, 113 that are similar to longitudinal straps 12, 42 previously described, that can wrap and be fastened about loops 115, 117, that are pre-attached to an upper horizontal rectangular planar strap 120 running across the compartment 110. Mid-portions of the upper longitudinal straps 12, 42 can be wrapped about stem portions of air valves 3, 6 that are located on the cylinders 2, 4, so that the straps 12, 42 hold the cylinders 2, 4 to the bag 1.

Along a rear side of the bag 110 behind cylinders 8 can be a mesh material 160 that can be formed from a flexible and pliable nylon mesh type material, with open pores, and the like, which functions similar to mesh material 60 previously described.

Mesh backing material 160 can be attached to upper horizontal strap 120 and to lower horizontal rectangular planar strap 150. Attached to both the upper horizontal strap, 120 and the lower horizontal strap 150 can be parallel vertical planar rectangular straps 132, 134. Straps can be attached to one another by sewing, webbing, and the like. Between the vertical straps 132, 134, can be another vertical strap 135. The straps 132, 134, 135, can be attached to the mesh material 160 by sewing, and the like.

Five Cylinders Triangular Bag Embodiment

A five cylinder bag embodiment can also have a similar triangular configuration with similar type compartments, webbing, straps, and the like. A five cylinder bag embodiment can have two rows of tank compartments, with a first row having approximately two tank compartments, and a second row having three tank compartments. The five cylinders embodiment can be especially used for handling and carrying small oxygen tanks therein.

Four Cylinders Bag Embodiment

Figure 12B:
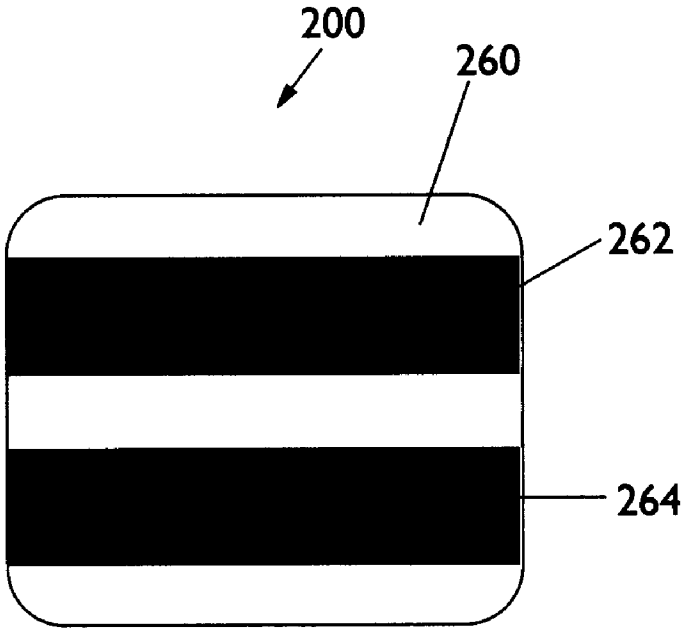
FIG. 12B is a bottom view of the tank tote of FIG. 9.
Figure 9:
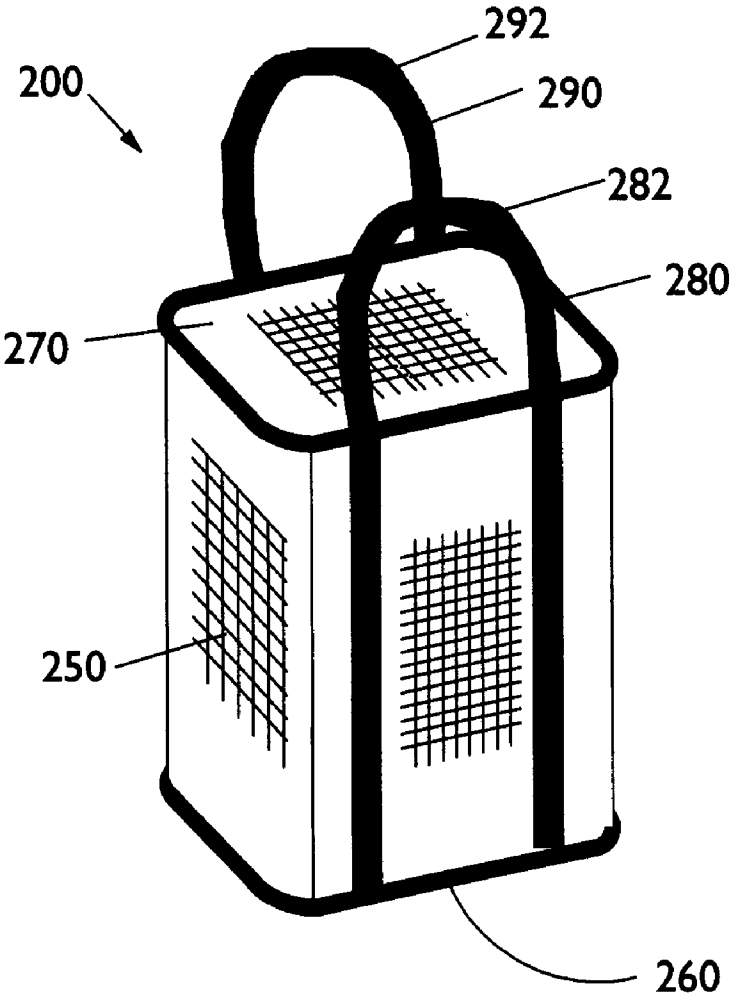
FIG. 9 is a perspective view of a four pack closed tank tote with a closed top.
Figure 10B:
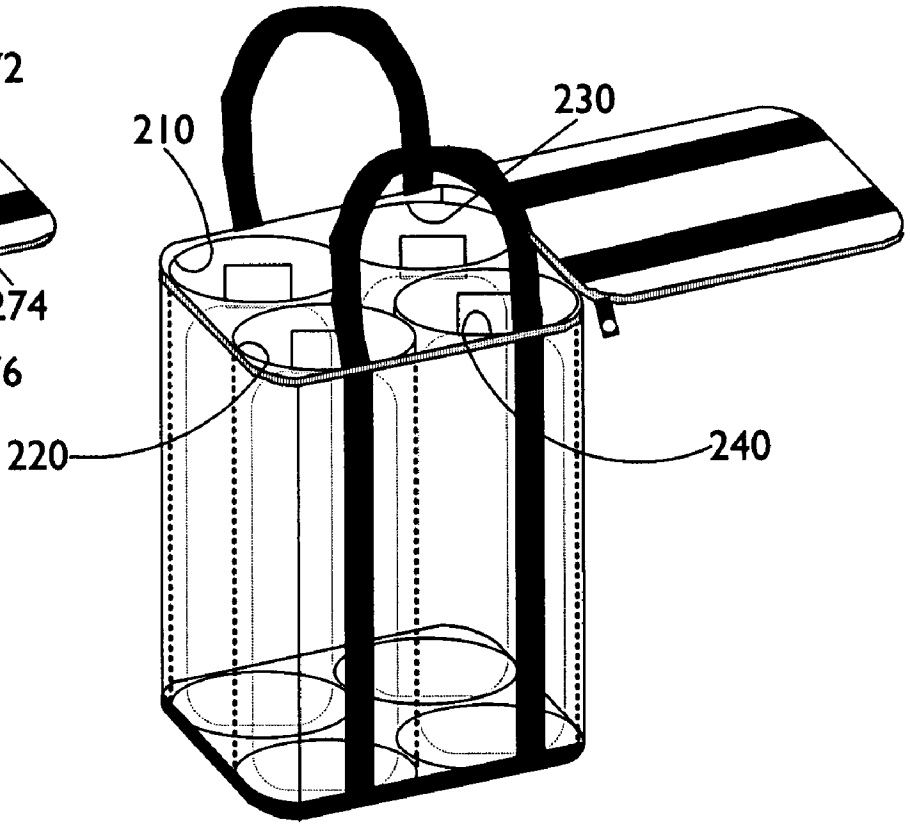
FIG. 10B is another view of FIG. 10A showing partial interior view of four compartments.
Figure 10A:
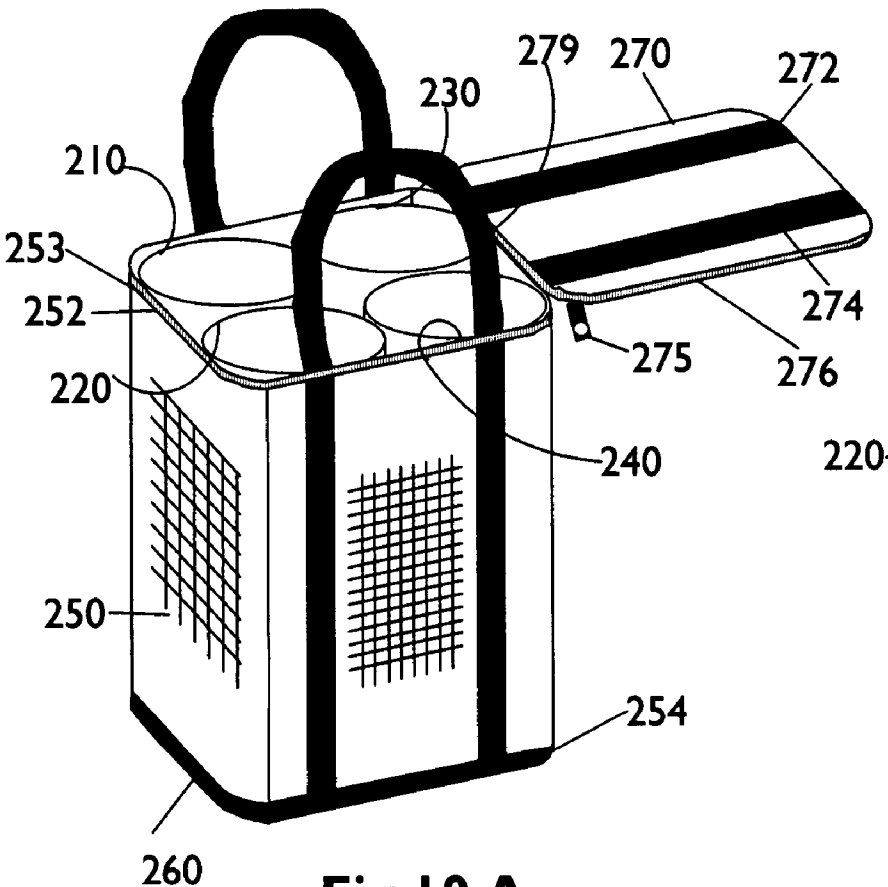
FIG. 10A is a perspective view of the four pack tank tote of FIG. 9 with top open.

FIG. 9 is a perspective view of a four pack closed tank tote 200 with a closed top 270. FIG. 10A is a perspective view of the four pack tank tote 200 of FIG. 9 with top 270 in an open position. FIG. 10B is another view of FIG. 10A showing partial interior view of four compartments 210, 220, 230, 240. FIG. 11 is a top view of the tank tote 200 of FIGS. 10A-10B with open top. FIG. 12A is a top view of the tank tote 200 of FIG. 9 with closed top 270. FIG. 12B is a bottom view of the tank tote 200 of FIG. 9. FIG. 14 is a side view of a single compartment 210 used in the tank tote 200 of FIGS. 9-12. FIG. 15 is a top view of the single compartment 210 of FIG. 14.

Referring to FIGS. 9-14, a four compartment tote bag 200 can include an outer layer 250 of a mesh material that can be formed from a flexible and pliable nylon mesh type material, with open pores, and the like, which functions similar to mesh materials previously described. Outer layer 250 can have a substantially rectangular configuration, and have a bottom flap 260 also formed from a similar mesh material with a sewn side edge flap strap material 254 that attaches the bottom flap 260 to the bottom of the rectangular outer layer 250. Across the bottom flap 260 can be a pair of sewn on exterior located straps 262, 264, similar to those previously described for giving rigidity and strength to the bottom flap 260.

Extending upward along opposite sides of the rectangular outer layer 250 can be a pair of sewn on straps 280, 290 with upwardly extending portions 282, 292 forming handles for allowing the bag 20 to be handled and held by the handle portions 292, 282. The top of the bag 200 can be a lid flap 270 formed from similar mesh material with a pair of internal side located sewn on straps 272, 274. Around a perimeter edge of the top flap 270 can be a sewn on strap edge 276. One side edge of the top flap 270 can be sewn directly to an upper side edge of the rectangular outer layer 250 to form a hinge portion for the top flap 270. Along an upper edge of the rectangular outer layer 250 can be a sewn on strap edge 252 with a zippered portion that can be fastened by a zipper 275 to a similar zippered portion to allow the top flap 270 to function as a lid that can be opened and closed to access the interior of the bag 200.

Inside the rectangular outer layer 250 can be four identical compartments 210, 220, 230, 240 for safely holding and separating cylinder tanks of various sizes from one another. A compartment 210 is shown having a tubular container formed from a mesh material 215 similar to those previously described, and a sewn on top pliable and flexible strap material edge 212, and a side sewn on strap edge 214, that is directed toward a middle portion of the bag 200, so that all four side edges face one another. Tank cylinders 212, 222, 232, 242 can be easily slipped into the open tops of each tubular container 210, 220, 230, 240 can be supported by bottom flap 260. Top flap 260 can be fastened into a closed position on the bag 200, allowing the bag to positioned in a vertical upright position, or laid down in an horizontal position.

When not being used, the bags 1, 100, 200 are pliable enough to be folded up into a small space such as a duffel bag or trunk compartment, and the like.

The weights of the novel tote bags are no more than approximately ½ pound each which is substantially less than the weight of prior art devices. Also, the novel invention embodiments can be folded together into compact spaces.

Although the preferred embodiments describes hook and loop fasteners for attaching straps together, the invention can be used with other types of fasteners such as snaps, buckles, and the like. Additionally, the strap ends can be tied to one another for fastening purposes. Still furthermore, the straps can have different shapes, and include rope, cable material, and the like.

The tank bags can be manufactured in a variety of colors.

Although the embodiments are described for supporting oxygen tanks, the invention can be used for other types of tanks, such as but not limited to medical oxygen tanks, diving tanks, welding tanks, and the like, of different sizes, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A tank container bag, comprising:

a first compartment formed from tubular pliable and flexible mesh material, adapted for holding a first cylindrical tank therein;

a second compartment formed from tubular pliable and flexible mesh material, adapted for holding a second cylindrical tank therein, the first compartment being attached in a side-by-side to the second compartment in a combined arrangement, a top lid formed from a pliable and flexible mesh material that is positioned from a flap open position to a closed position, the top lid includes a strap material formed from a pliable and flexible material running down a middle portion of a pliable and flexible mesh material of the top lid; and a bottom cover formed from a pliable and flexible material for substantially closing a bottom of the bag, the bottom cover includes a strap material formed from a pliable and flexible material running down a middle portion of the pliable and flexible mesh material of the bottom cover, wherein the combined arrangement allows for the first cylindrical tank and the second cylindrical tank to be stored in an upright vertical position, and allows for the bag to be handled and carried by a single user.

2. The tank container bag of claim 1, further comprising:

a pliable and flexible mesh material for covering a rear side of the bag, so that top ends, and front sides of the first and the second cylindrical tanks are left exposed.

3. The tank container bag of claim 2, wherein the combined arrangement of the first compartment and the second compartment includes:

four vertical straps parallel to one another forming a back of the bag with the mesh material attached across the four vertical straps.

4. The tank container bag of claim 2, further comprising:

an inwardly folded vertical edge of mesh material midway down the mesh material for separating the first tank from the second tank.

5. The tank container bag of claim 1, wherein the first pliable and flexible mesh material covers a rear side of the first and the second compartments of the bag, so that top ends, and front sides of the first and the second cylindrical tanks are exposed.

6. The tank container bag of claim 5, wherein the second pliable and flexible mesh material covers a rear side of the third compartment of the bag, so that a top end and front side of the third cylindrical tank are exposed.

7. A tank container bag, comprising:

a first tubular compartment of pliable and flexible mesh material, adapted for holding a first tank therein;

a second tubular compartment of tubular pliable and flexible mesh material, adapted for holding a second tank therein, the first compartment being attached side-by-side to the second compartment;

a top lid formed from a pliable and flexible material, having a separate strap material formed from a pliable and flexible material running down a middle portion of the top lid; and a bottom cover formed from a pliable and flexible material for substantially closing a bottom of the bag, having a separate strap material formed from a pliable and flexible material running down a middle portion of the bottom cover, wherein the bag allows for the first cylindrical tank and the second cylindrical tank to be stored in an upright vertical position, and also be carried in a horizontal position.

8. The container bag of claim 7, wherein the top lid and the bottom lid include a mesh material.

9. The container bag of claim 8, wherein the strap material on the top lid and the strap material on the bottom lid include a mesh material.

10. A tank container bag, comprising:

a bag housing having a substantially rectangular configuration formed from a pliable and flexible mesh material adapted for holding at least one tank therein, the bag housing having an upper open end and a bottom end;

a top lid formed from a pliable and flexible material which covers the upper open end of the bag housing, the top lid having a separate strap material formed from a pliable and flexible material running down a middle portion of the top lid, the top lid having an open flap position, and a closed position; and a bottom cover formed from a pliable and flexible material for substantially closing the bottom end of the bag housing, the bottom cover having a separate strap material formed from a pliable and flexible material running down a middle portion of the bottom cover, wherein the bag allows for the at least one store tank to be stored in an upright vertical position, and be carried in a horizontal position; and first tubular compartment of pliable and flexible mesh material inside of the bag housing, adapted for holding a first tank therein;

a second tubular compartment of tubular pliable and flexible mesh material inside of the bag housing, adapted for holding a second tank therein, the first compartment being attached side-by-side to the second compartment.

11. The container bag of claim 10, wherein the strap material on the top lid includes: a pair of straps running down the middle portion of the top lid.

12. The container bag of claim 10, wherein the strap material on the bottom cover includes: a pair of straps running down the middle portion of the bottom cover.

* * * * *